United States Patent [19]

Provost

[11] Patent Number: 4,752,355

[45] Date of Patent: Jun. 21, 1988

[54] PRESSBOARD AND PROCESS FOR ITS PREPARATION

[76] Inventor: Richard L. Provost, 11800 Deerhurst Dr., Midlothian, Va. 23113

[21] Appl. No.: 887,947

[22] Filed: Jul. 22, 1986

Related U.S. Application Data

[63] Continuation of Ser. No. 697,797, Feb. 4, 1985, abandoned, which is a continuation-in-part of Ser. No. 589,601, Mar. 14, 1984, abandoned.

[51] Int. Cl.[4] ..... D21H 5/20

[52] U.S. Cl. ..... 162/123; 162/129; 162/130; 162/132; 162/138; 162/146; 162/157.3; 162/206

[58] Field of Search ..... 162/123, 129, 130, 132, 162/146, 157.3, 138, 206; 428/287, 284

[56] References Cited

U.S. PATENT DOCUMENTS

| | | | |
|---|---|---|---|
| 3,756,908 | 9/1973 | Gross | 162/146 |
| 4,060,451 | 11/1977 | Uchiyama et al. | 162/146 |

FOREIGN PATENT DOCUMENTS

| | | | |
|---|---|---|---|
| 2815451 | 3/1979 | Fed. Rep. of Germany | 162/146 |
| 2302379 | 9/1976 | France | 162/157.3 |
| 52-43886 | 4/1977 | Japan | 162/146 |
| 52-63268 | 5/1977 | Japan . | |
| 52-63269 | 5/1977 | Japan . | |
| 54-50613 | 9/1977 | Japan . | |

*Primary Examiner*—Peter Chin

*Attorney, Agent, or Firm*—John C. Andrade

[57] ABSTRACT

High temperature resistant pressboard having a desirable combination of compression set values and oil absorption is prepared by a process whereby a low density pressboard is first prepared by forming a wet lap of multiple layers of a waterleaf containing 50–95% by weight water and pressing the wet lap at 100–200° C. under a pressure of 10–60 kg/cm$^2$, drying, ultimately at 270°–320° C. until substantially no further moisture is evolved and finally pressing at 270°–320° C. under a pressure of 8–350 kg/cm$^2$ and optionally cooling under restraint.

14 Claims, No Drawings

PRESSBOARD AND PROCESS FOR ITS PREPARATION

CROSS-REFERENCE TO RELATED APPLICATION

This is a continuation of application Ser. No. 697,797, filed Feb. 4, 1985, abandoned, which is a continuation-in-part of Ser. No. 589,601, filed Mar. 14, 1984, abandoned.

DESCRIPTION

1. Technical Field

This invention relates to an improved aromatic polyamide pressboard having increased resistance to compression combined with relatively high oil absorption characteristics. The invention also relates to a process for preparing the improved pressboard.

2. Background of the Invention

Pressboard prepared from cellulosic materials has been known and commercially used for many years. While the cellulosic pressboard is extremely useful, its use at high temperature is limited by the low thermal stability of cellulosic materials.

More recently, aromatic polyamide fibers (U.S. Pat. Nos. 3,063,966 and 3,133,138), fibrids (U.S. Pat. No. 2,999,788) and paper (U.S. Pat. No. 3,756,908) having excellent properties at high temperatures have become known. Pressboard comprised of aromatic polyamide fibers and fibrids is also known and can readily be prepared using the same procedures used in the preparation of cellulosic pressboard.

Aromatic polyamide pressboard has been found to be useful in many applications. For example, in oil filled transformers it has been found to have a suitably high oil absorption which contributes to good electrical insulating properties. However, for some uses, it is necessary that the pressboard not only have a suitably high oil absorption but also provide resistance to compression so that the pressboard can provide suitable separation of electrically conducting components. It has been found that compaction processes as taught by the prior art either do not provide pressboard products having adequate resistance to compression, or that they do so only by providing a pressboard product which does not have adequate oil absorption.

This invention provides an improved aromatic polyamide pressboard having a combination of good resistance to compression and adequate oil absorption. This invention also provides a process for the preparation of the improved pressboard.

BRIEF DESCRIPTION OF THE INVENTION

This invention provides a high density pressboard comprised of 20–95% by weight aromatic polyamide fibrids and 80–5% by weight high temperature resistant floc, said pressboard having a calculated void volume of 13 to 28% by volume of the pressboard, a thickness of 0.5 to 50 mm, a mercury intrusion volume at low surface/volume, $V_{ml}$, of less than 0.20 $cm^3/g$; a mercury intrusion volume at high surface/volume, $V_{mh}$, of 0.08 to 0.28 $cm^3/g$, an oil absorption by volume in $cm^3/g$, $V_o$, of 0.09 to 0.28 and by weight 8–24%; and a total available absorption volume in $cm^3/g$, $V_a$, equal to the largest of the values for $V_{ml}$, $V_{mh}$, and $V_o$; the ratio of $V_a$ to $V_{ml}$ being at least 1.1; said pressboard having a compression set (as hereinafter defined) of greater than 0.12 mm but no more than 0.5 mm. Preferably the pressboard is comprised of 50–70% by weight aromatic polyamide fibrids and 30–50% by weight high temperature resistant floc. Preferably the high temperature resistant floc consists of an aromatic polyamide and the pressboard has a density of 1.00 to 1.20 $g/cm^3$. Preferably the aromatic polyamide fibrids and high temperature resistant floc consist essentially of poly(m-phenylene isophthalamide)(MPD-I). The pressboard preferably is comprised of aromatic polyamide fibrids and floc and has a thickness of 1 to 10 mm, a density of 1.02 to 1.17 $g/cm^3$, most preferably 1.10 to 1.15 $g/cm^3$. The pressboard preferably has a compression set of 0.12 to 0.35 mm, most preferably 0.20 to 0.30 mm.

The improved pressboard is prepared by a process whereby an aqueous slurry having 0.1 to 2% by weight total solids comprised of 20–95% by weight aromatic polyamide fibrids and 80–5% by weight high temperature resistant floc having a length of 2 to 12 mm., said aromatic polyamide fibrids and high temperature resistant floc having a melting point higher than 320° C., the slurry is formed into a waterleaf having a water content of 50–95% by weight, the waterleaf is combined into multiple layers to form a wet lap, the wet lap is pressed at 100° to 200° C. under a pressure of 10 to 60 $kg/cm^2$ to form a low density pressboard having a calculated void volume of 30 to 60% by volume of the pressboard, the low density pressboard is dried, ultimately at 270°–320° C., until substantially no further moisture is evolved and finally pressed at 8 to 350 $kg/cm^2$ at 270°–320° C. Preferably the temperature is 275°–300° C. Most preferably, the final pressing is at 275°–285° C. and the pressure is 15 to 70 $kg/cm^2$. Preferably the pressboard is cooled under restraint. Preferably the high temperature resistant floc consists of an aromatic polyamide. Preferably the aromatic polyamide fibrids and the high temperature resistant floc consist of poly(m-phenylene isophthalamide).

DETAILED DESCRIPTION OF THE INVENTION

Definitions

By "aromatic polyamide" is meant nonfusible polyamides wherein the amide group, i.e., the

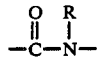

radical where R is hydrogen or a 1–6 carbon alkyl group, of each repeating unit is linked through the nitrogen atom and the carbon atom to a carbon atom in the ring of separate aromatic ring radicals. The term "aromatic ring" is defined herein as a carbocyclic ring possessing resonance.

By "aromatic polyamide fibrids" is meant small, nongranular, nonrigid fibrous or film-like particles of an aromatic polyamide having a melting point higher than 320° C. Two of their three dimensions are of the order of microns. Their smallness and suppleness allows them to be deposited in physically entwined configurations such as are commonly found in papers made from wood pulps. Fibrids can be prepared by precipitating a solution of the aromatic polyamide into a coagulant such as in apparatus of the type disclosed in U.S. Pat. No. 3,018,091.

By "high temperature resistant floc" is meant short fibers, typically having a length of 2 to 12 mm and a linear density of 1–10 decitex, made of a material having a melting point higher than 320° C., such as aromatic polyamides, aromatic polyamide-imides, aromatic polyimides, polybenzimidazoles, etc., or inorganic materials such as glass, ceramic materials, alumina, etc. Other high temperature resistant materials such as mica may also be present in relatively finely subdivided form.

By "aromatic polyamide floc" is meant short fibers cut from fibers prepared by the processes described in U.S. Pat. Nos. 3,063,966, 3,133,138, 3,767,756, and 3,869,430.

Conventional aromatic polyamide pressboard may be prepared by feeding an aqueous slurry of MPD-I fibrids and MPD-I floc to a cylinder paper forming machine whereby water is removed and multiple layers of fibrous material having a water content of 50–95% by weight of the wet sheet is built up to a wet lap of the desired thickness. The wet lap is cut from the cylinder, laid flat and pressed at 100°–200° C., under a pressure of 10–60 kg/cm$^2$. The resulting conventional pressboard usually has a high oil absorption of 20–50% by weight, a density of about 0.7 to 0.9 g/cm$^3$, a calculated void volume of about 35 to 50% by volume of the pressboard, mercury intrusion volume of about 0.30 to 0.50 cm$^3$/g, both at low and high surface/volume, a ratio of total available absorption volume in cm$^3$/g, $V_a$, to the mercury intrusion volume at low surface/volume, $V_{ml}$, of about 1 and a compression set of 0.75 to 2.5 mm.

However, for some uses, such as spacers used in oil filled transformers, the compression set desirably should be not less than about 0.12 mm or more than about 0.5 mm while maintaining an oil absorption of at least 8%. Pressboard with compression set values of less than about 0.12 mm do not have the combination of compressibility and resilience necessary to maintain proper spacing of electrical components in, e.g., transformers. Pressboard with compression set values greater than 0.5 mm likewise do not maintain proper spacing of components.

The above desired properties are provided by the product of this invention. It has been found that when a low density pressboard having a calculated void volume of 30 to 60% prepared as described above is further dried, ultimately at a temperature of 270°–320° C., until substantially no further moisture is evolved and then pressed at 270°–320° C. and a pressure of 8 to 350 kg/cm$^2$, preferably followed by cooling under restraint, a pressboard having the desired properties is obtained. The drying is preferably accomplished by step-wise increase in temperature. Moisture evolution is facilitated by application and release of light pressure. In general, the pressing is preferably at 275°–300° C. at 15 to 70 kg/cm$^2$ for at least 5 minutes but thick products may require pressing for longer times. More than one layer of low density pressboard may be combined during high temperature pressing. In this case, longer pressing times should be employed. Preferably the high temperature pressing should be above the glass transition temperature ($T_g$) of the aromatic polyamide comprising the fibrids which in the case of the preferred poly(m-phenylene isophthalamide) fibrids is about 275° C.

It has been found that the process described above, wherein a wet lap is formed of multiple layers of waterleaves having a water content of 50–95% and the wet lap is pressed at 100°–200° C. under a pressure of 10–60 kg/cm$^2$ to prepare a low density pressboard having a calculated void volume of 30–60%, and the low density pressboard is then dried and pressed again at 270°–320° C. under a pressure of 8–350 kg/cm$^2$, is essential for obtaining a pressboard product exhibiting good resistance to compression as well as adequate oil absorption. If the low density pressboard has a calculated void volume of less than 30%, the oil absorption of the final pressboard product tends to be very poor.

The pressboard of this invention is useful in clamping rings and in axial and radial spacers in oil filled electrical transformers.

Products of this invention have a calculated void volume of 13 to 28% by volume of the pressboard, mercury intrusion volumes at low surface/volume, $V_{ml}$, of less than 0.20 cm$^3$/g and at high surface/volume, $V_{mh}$, of 0.08 to 0.28 cm$^3$/g, an oil absorption by volume in cm$^3$/g, $V_o$, of 0.08 to 0.28 and by weight of 8–24% and a total available absorption volume in cm$^3$/g, $V_a$, equal to the largest of the values for $V_{ml}$, $V_{mh}$ and $V_o$, the ratio of $V_a$ to $V_{ml}$ being at least 1.1. Pressboard having a calculated void volume of more than 28% or a ratio of $V_a$ to $V_{ml}$ of 1.0 generally exhibits poor compression set, while pressboard having a calculated void volume of less than 13% or $V_{mh}$ less than 0.08 cm$^3$/g generally exhibits poor oil absorption. The products of this invention have $V_a$ values which are quite different from $V_{ml}$ values, the ratio of these being at least 1.1 and as high as 4.

TESTS

Density. Dry pressboard is cut into a rectangular sample measuring at least 10 cm×10 cm (4 in×4 in), preferably at least 20 cm×20 cm (8 in×8 in), making sure that the corners are cut square so that the upper and lower faces of the sample are of the same area and that the dimensions can be measured accurately. The length and width of the rectangular sample are measured to an accuracy of at least 0.25 cm (0.1 in). The thickness of the rectangular sample of pressboard is measured in at least ten places spaced substantially equally apart around all sides of the pressboard, away from the edges, using a micrometer caliper which contacts the sample with surfaces having a diameter of about 0.6 cm (0.25 in) at a pressure of about 0.1 kg/cm$^2$ (about 1.25 psi), to an accuracy of at least 0.00025 cm (0.1 mil), averaging the ten thickness measurements. The sample of pressboard is then weighed to the nearest 0.0001 g. The volume of the sample of pressboard $V_b$ is then calculated in cm$^3$ and the weight is divided by the volume to give the density in g/cm$^3$.

Calculated Void Volume. The void volume in cm$^3$, $V_v$, of a sample of the pressboard is determined from the relationship $$V_b = V_m + V_v,$$

or $$V_v = V_b - V_m,$$

where $V_b$ is the volume of the pressboard in cm$^3$ as determined above, $V_m$ is the total volume in cm$^3$ of all the materials comprising the pressboard, and $V_v$ is the remaining volume in cm$^3$, which is taken as the void volume. $V_m$ is determined from the weights and densities of each of the materials of which the pressboard sample is made, calculated as follows:

$$V_m = \frac{W_f}{1.38\ g/cm^3} + \frac{W_i}{\rho_i},$$

where $W_f$ is the weight in g of the aromatic polyamide fibrids in the pressboard sample, $W_i$ is the weight in g of the floc (including any other non-fibrid high temperature resistant material) in the pressboard sample, and $\rho_i$ is the density of the material of which the floc is made [1.38 g/cm$^3$ for MPD-I and 1.44 g/cm$^3$ for poly(p-phenylene terephthalamide)]. When there is more than one kind of floc (or other high temperature resistant material such as mica), $W_i/\rho_i$ is calculated as follows:

$$\frac{W_i}{\rho_i} = \frac{W_1}{\rho_1} + \frac{W_2}{\rho_2} + \ldots + \frac{W_n}{\rho_n}$$

where i=1, . . . , n. The calculated void volume as a percentage volume, % $V_v$, is then calculated as follows:

$$\%\ V_v = \left[1 - \frac{V_m}{V_b}\right] \times 100 = \left[\frac{V_b - V_m}{V_b}\right] \times 100$$

In the case of a 100% MPD-I pressboard sample having a weight in g of $W_b$ and a volume in cm$^3$ of $V_b$, and since for this case $$V_m = \frac{W_b}{1.38\ g\ cm^3}$$

the equation reduces to:

$$\%\ V_v = \left[1 - \frac{W_b}{V_b \cdot 1.38\ g/cm^3}\right] \times 100$$

The calculated void volume is a measure of all of the voids, both isolated voids and interconnected voids, in a sample of pressboard.

Oil Absorption. This test is carried out in accordance with the method described by the International Electrotechnical Commission, IEC Standard, Publication 641-2, First edition (1979), "Specification for pressboard and presspaper for electrical purposes, Part 2: Methods of test," pages 29 and 31 (section 17), published by Bureau Central de la Commission Electrotechnique Internationale Geneva, Switzerland. The result is expressed to the nearest 0.1% as a percentage by weight oil absorption on the original mass of the pressboard sample tested. The oil absorption by volume in cm$^3$/g, $V_o$, is then calculated by dividing the percentage by weight oil absorption by the density of the sample of pressboard. $V_o$ values are initially reported to the same number of significant figures as the percentage by weight oil absorption, then rounded to two decimal places.

Compression Set. The pressboard to be tested is cut into rectangular strips 3.8 cm (1.5 in) wide×5.1 cm (2.0 in) long and a sufficient number of the strips are stacked to make a stack approximately 5.1 cm (2.0 in) high. The stack of samples is placed in an oven for 48 hrs. at 110° C., then taken from the oven and placed in a conventional machine for testing compressive properties, equipped for constant rate of crosshead movement and having a capacity of at least 10,000 kg (22,000 lb.) (e.g., the Tinius Olsen Universal Testing Machine, Model 60 SDT, Servo-controlled, 60,000 lb. capacity, Super L UTM, made by the Tinius Olsen Universal Testing Machine Co., Inc., Easton Rd., Willow Grove, PA 19090 equipped with a Model MM Flat Bed X-Y Recorder manufactured by Houston Instruments, Inc. and Tinius Olsen Model D-2 and D-4 Deflectomers for accurately measuring the deflection of compressed samples at two different chart magnifications). In carrying out the test, the load is applied at the constant rate of 0.5 cm per min. (0.2 in. per min.) and released. A load of 680 kg (1,500 lb.), equivalent to 35 kg/cm$^2$ (3,448 kPa; 500 psi), is applied to the stack of samples, and the load is then immediately released to a load of 136 kg (300 lbs.). This load, equivalent to 7 kg/cm$^2$ (690 kPa; 100 psi), is designated as the bedding pressure, and the load is released to this bedding pressure between each cycle. The stack of samples is next cycled to 1361 kg (3,000 lbs.), equivalent to 70 kg/cm$^2$ (6,895 kPa; 1,000 psi), returning to the bedding pressure. It is then cycled to 2,722 kg (6,000 lbs.), equivalent to 141 kg/cm$^2$ (13,790 kPa; 2,000 psi), returning to the bedding pressure. Finally it is cycled to 4,082 kg (9,000 lbs.), equivalent to 211 kg/cm$^2$ (20,685 kPa; 3,000 psi), and back once more to the bedding pressure. The compression set is taken as the loss in height in mm (alternatively in mils) of the stack of samples, as measured by the deflectometer, upon the return to the bedding pressure after the final cycle. It is preferred to have the deflectomer readings continuously plotted on a chart so that the entire sequence of cycles is displayed on a graph for each sample tested.

It the amount of sample material is limited, the 3.8 cm×5.1 cm rectangular strips are stacked to a lesser height, preferably at least 2.55 cm (1.0 in.) high, and the deflection after the final cycle is multiplied by the appropriate factor to scale the result to correspond to the result which would be obtained from a stack 5.1 cm (2.0 in.) high.

Mercury Intrusion Volume. In this determination a conventional mercury porosimeter (Aminco Mercury 60,000 psig max, Newport Scientific Co., Inc., Silver Spring, MD 20910) is employed to determine the volume of mercury which can be forced into the pores, or interconnected voids, of a porous sample. To determine whether the surface area of a given weight of the pressboard has an effect on the volume of mercury which can be forced into its pores, determinations are made both on low surface/volume samples and high surface/volume (subdivided) samples of the pressboard.

The nominal weight of each sample tested is 0.3 g. To prepare the low surface/volume and high surface/volume samples, an initial sample slightly heavier than 0.6 g and preferably rectangular in shape is cut from the pressboard to be tested. The initial sample is then cut down in size (e.g. with a pair of side-cutters) in a series of approximately 25 to 35 clean cuts straight through the pressboard near its edges to produce a corresponding number of fragments, leaving a preferably quadrilateral sample weighing about 0.3 g which is taken as the sample for the low surface/volume measurement. This low surface/volume sample should be of such shape that it will fit intact in the penetrometer bulb (sample chamber) of the porosimeter, if at all possible. If the sample is very thin and a single piece weighing 0.3 g which will fit in the penetrometer bulb cannot be prepared, the low surface/volume sample is prepared in the form of two or even three pieces which will fit in the bulb. The low surface/volume sample is weighed to the nearest 0.0001 g on glassine paper. A sufficient number of the pressboard fragments, preferably about 25 to 30, to weigh about 0.3 g are placed on glassine paper (preferably they are collected on the glassine paper as they are cut) as the high surface/volume (subdivided) sample. The subdivided sample is weighed to the nearest 0.0001 g.

To conduct the determination, a weighed sample is placed in the open penetrometer bulb, after which the bulb is capped and evacuated until the vacuum gauge displays a pressure of 50 microns of mercury or less. The filling device is then tilted backward until its stop is reached, so that the tip of the penetrometer is immersed in mercury. The stopcock on the filling device is gradually opened to admit air to the system slowly, causing mercury to enter the penetrometer bulb, tapping the tubes to aid in wetting the sample with mercury. After total wetting has been achieved, the filling device is returned to vertical position. The penetrometer is then moved from the vacuum chamber to the pressure chamber.

The pressure is then gradually increased, recording penetrometer readings at intervals as the pressure increases. The equipment is customarily provided with more than one pressure gauge, e.g. recording maximum values of about 350 kg/cm$^2$ (34 MPa; 5,000 psi) and about 4200 kg/cm$^2$ (414 MPa; 60,000 psi), and if so the equipment is switched over to the high pressure gauge at the appropriate time as the pressure increases. The penetrometer reading at 4200 kg/cm$^2$ (414 MPa; 60,000 psi) is recorded at the conclusion of the test. The mercury intrusion volume at 4200 kg/cm$^2$ is determined from the penetrometer reading in accordance with the instructions provided by the manufacturer of the equipment. For a particular specimen of pressboard, mercury intrusion volume values in cm$^3$/g (cm$^3$ of mercury at 4200 kg/cm$^2$ pressure per g of pressboard) are first determined to four decimal places, then rounded and finally reported to two decimal places both for the low surface/volume and high surface/volume (subdivided) samples. If desired, graphs of mercury intrusion volume values over the entire pressure range are constructed, based on the penetrometer readings taken at intervals throughout the test. The mercury intrusion volume at low surface/volume is designated by the symbol, $V_{ml}$, and the mercury intrusion volume at high surface/volume is designated by the symbol, $V_{mh}$.

Total Available Absorption Volume. The total available absorption volume, $V_a$, of a pressboard sample is taken as being equal to the largest of the values for $V_{ml}$, $V_{mh}$ and $V_o$ (all values prior to rounding) for the sample. For any given sample of pressboard, $V_a$ is a measure of the volume in cm$^3$ per g of the interconnected voids in the sample which are accessible to penetration by liquids.

The ratio, $V_a/V_{ml}$, is then calculated, using values of $V_a$ and $V_{ml}$ prior to rounding in making the calculation. In reporting the ratio, it is rounded to one decimal place. A value of this ratio equal to or greater than 1.1 is indicative of a structure of limited or partial accessibility of internal voids in the pressboard, a structure associated with good compression resistance of the pressboard when the calculated void volume of the pressboard is no more than 28%.

EXAMPLE 1

A. Preparation of "Standard Pressboard"

Filaments of poly(m-phenylene isophthalamide) (MPD-I) having an inherent viscosity of 1.5 were dry spun from a solution containing 19% MPD-I, 70% dimethylacetamide (DMAc), 9% calcium chloride, and 2% water. On leaving the drying tower the as-spun filaments were given a preliminary wash with water so that they contained about 60% DMAc, 15% calcium chloride, and 100–150% water, based on the weight of dry polymer. The filaments were washed and drawn 4X at 90° C. in a counter-current extraction-draw process in which the calcium chloride determined as chloride content and DMAc content were reduced to about 0.1% and 0.5%, respectively. The filaments were crystallized immediately after drawing by passing them over hot rolls at a temperature of about 340° C. The filaments so produced had a linear density of 2.2 decitex (2.0 denier), a tenacity of about 3.7 dN/tex (4.2 g/denier), an initial modulus of 70 dN/tex (79 gpd) and an elongation of 34%. The filaments were cut to floc having a length of 3.4 mm (0.135 in).

Fibrids of MPD-I having an inherent viscosity of 1.5 were prepared substantially as described by Gross in U.S. Pat. No. 3,756,908, issued Sept. 4, 1973, column 5 lines 34–54, stopping short of the refining step.

An aqueous slurry was prepared containing 1.0 wt. % fibrids and floc having a composition of 60% of the above MPD-I fibrids and 40% of the above MPD-I floc. The slurry was held in an agitated vessel and then pumped to a double disc refiner (Beloit Jones Model 3000 20-inch Double Disc refiner, made by the Jones Division of the Beloit Corporation, Dalton, Mass. 01226), equipped with refining discs containing narrow bars and channels with surface dams. The plates of the refiner were positioned with a gap of 0.5 mm (20 mils) between the rotor and the stator plates. The rotor plates were operated at 900 rpm. After passing through the refiner, the slurry was passed through a second refiner under the same operating conditions. After the two passes through the refiners the fibrids in the slurry were well reduced in size and well opened into fibrid films, while the floc fibers were well distributed among the fibrids. The slurry made in this way was then diluted to approximately 0.1% by weight solids and fed to a conventional cylinder wet paper-making machine upon which a continuous sheet of wet paper was made and transferred to an endless felt, the moisture content being adjusted by suction and pressure to about 400% based on solids (80% by weight based on the wet sheet). The weight of the solids in the wet paper was approximately 36 g/m$^2$. The continuous wet sheet was next delivered to a forming roll, where it was wound continuously on a cylindrical tube until it overlapped about 70 times. A longitudinal cut was then made in the layered paper and the entire thickness of wet lap (wet layered paper) was then removed and placed between the platens of a hot press, the platens being maintained at 140° C. and having been covered with wire screen to facilitate moisture removal. The press was loaded at contact pressure, and the pressure was then raised to and maintained for one hour at 35 kg/cm$^2$ (3450 kPa; 500 psi) while the platens of the press were maintained at 140° C. The product, herein designated as "Standard Pressboard", was a low density aramid pressboard approximately 3.2 mm (126 mils) thick. It was found to have a density of 0.82 g/cm$^3$, a calculated void volume, % $V_v$, of 41% by volume of the pressboard, a compression set of 2.13 mm (84 mils), and an oil absorption of 32.5%. $V_o$ was 0.38 $cm^3/g$, $V_{ml}$ was 0.38 $cm^3/g$ (rounded from 0.3791), and $V_{mh}$ was 0.42 $cm^3/g$ (rounded from 0.4197). $V_a$ for this Standard Pressboard sample was 0.42 $cm^3/g$ and the ratio $V_a/V_{ml}$ was 1.1.

B. Preparation of Compression-Resistant Pressboard

A 30.5 cm×30.5 cm (12 in×12 in) square sheet of the "Standard Pressboard" prepared as in Part A above was predried at 150° C. for at least 2 hours and then placed between the platens of a flat press (Machine No. 9175-M, Watson Stillman Press Division, Farrel Company, Emhart Machinery Group, 25 Main St., Ansonia, Conn. 06401). With the platens preheated to 280° C. and maintained at that temperature, a pressure of 19.5 $kg/cm^2$ (1910 kPa; 277 psi) was applied to the "Standard Pressboard" for a total of 20 minutes, releasing the pressure for a few seconds and then reapplying it after a total of 1, 2, 3, 6, 12, and 16 minutes to permit escape of any trapped gases. After a total of 20 minutes of hot pressing, the pressboard was taken out hot, placed in another press at room temperature, and allowed to cool under a pressure of 2.8 $kg/cm^2$ (276 kPa; 40 psi), just sufficient to keep the pressboard flat while cooling. The product, designated as "Sample 1A", was an aramid pressboard approximately 2.45 mm (96.5 mils) thick (thickness range 2.35–2.53 mm). It was found to have a density of 1.11 $g/cm^3$, a % $V_v$ of 20%, a compression set of 0.30 mm (12 mils), and an oil absorption of 12.71%. $V_o$ was 0.15 $cm^3/g$, $V_{ml}$ was 0.15 $cm^3/g$ (rounded from 0.1502), and $V_{mh}$ was 0.17 $cm^3/g$ (rounded from 0.1700). $V_a$ for Sample 1A was 0.17 $cm^3/g$ and the ratio $V_a/V_{ml}$ was 1.1.

Another sheet of predried "Standard Pressboard" was subjected to the same procedure, except that a pressure of 18.5 $kg/cm^2$ (1813 kPa; 263 psi) was applied in the press for a total of 20 minutes at 280° C. The product, designated as "Sample 1B", was approximately 2.5 mm (98.7 mils) thick (thickness range 2.38–2.60 mm). It was found to have a density of 1.08 $g/cm^3$, a % $V_v$ of 22%, a compression set of 0.36 mm (14 mils), and an oil absorption of 12.19%. $V_o$ was 0.14 $cm^3/g$, $V_{ml}$ was 0.16 $cm^3/g$ (rounded from 0.1551), and $V_{mh}$ was 0.17 $cm^3/g$ (rounded from 0.1743). $V_a$ for Sample 1B was 0.17 $cm^3/g$ and the ratio $V_a/V_{ml}$ was 1.1.

EXAMPLE 2

Two 46 cm×122 cm (18 in×48 in) rectangular sheets of "Standard Pressboard", prepared substantially as described in Part A of Example 1 but having a thickness of 3.0 mm (118 mils), were aligned in a stack above and below a 46 cm×122 cm sheet of 1.6-mm thick "Standard Pressboard", similarly prepared except that proportionately fewer overlaps of wet paper were wound on the cylindrical roll in the forming step. All of the sheets were predried at 150° C. just before forming the stack. The aligned stack was then placed immediately in a hot press having platens oil-heated to 280° C. (535° F.) and subjected to three 2-minute cycles of contact pressure (3.5 $kg/cm^2$) at 280° C. followed by the release of pressure. A one-minute cycle of pressure at 28 $kg/cm^2$ (2758 kPa; 400 psi) and quick release was followed by a one-minute cycle of pressure at 35 $kg/cm^2$ and quick release, after which pressure was applied at 35 $kg/cm^2$ for fifteen minutes while the platens were maintained at 280° C. The pressboard product was taken out hot and placed under contact pressure in a separate press, initially at room temperature and water-cooled to absorb the heat of the pressboard, to keep it flat while cooling. The product, designated "Sample 2", was an aramid pressboard approximately 5.3 mm thick (210 mils). It was found to have a density of 1.12 $g/cm^3$, a % $V_v$ of 19%, a compression set of 0.13 mm (5 mils), and an oil absorption of 9.3%. $V_o$ was 0.11 $cm^3/g$, $V_{ml}$ was 0.09 $cm^3/g$ (rounded from 0.0940), and $V_{mh}$ was 0.17 $cm^3/g$ (rounded from 0.1665). $V_a$ for Sample 2 was 0.17 $cm^3/g$ and the ratio $V_a/V_{ml}$ was 1.8.

EXAMPLE 3

A 46 cm×81 cm (18 in×32 in) rectangular sheet of 2.1-mm thick pressboard, prepared substantially like the "Standard Pressboard" of Part A of Example I, except that proportionately fewer overlaps of wet paper were used, was placed without predrying in a press equipped for electrical heating and water cooling. Initially the press was at 66° C. (150° F.) and contact pressure, about 3.5 $kg/cm^2$ (345 kPa; 50 psi). The press was heated over about 20 minutes under the same contact pressure, with no intervals of pressure release, to about 280° C. (about 353° F.). The pressure was then increased to 35 $kg/cm^2$ (3448 kPa; 500 psi) and maintained at that pressure, with no release of pressure, for 12 minutes while the press was maintained at 280° C. The electrical heating was then discontinued and the press was then cooled back down to 66° C. with circulation of cool water over a 20-minute period while the pressure was maintained at 35 $kg/cm^2$. The product, designated "Sample 3", was an aramid pressboard approximately 1.6 mm thick (64 mils). It was found to have a density of 1.13 $g/cm^3$, a % $V_v$ of 18%, a compression set of 0.13 mm (5 mils), and an oil absorption of 9.32%. $V_o$ was 0.11 $cm^3/g$, $V_{ml}$ was 0.06 $cm^3/g$ (rounded from 0.0553), and $V_{mh}$ was 0.14 $cm^3/g$ (rounded from 0.1390). $V_a$ for Sample 3 was 0.14 $cm^3/g$ and the ratio $V_a/V_{ml}$ was 2.5.

EXAMPLE 4

Square sheets of low density pressboard were prepared in substantially the same manner as the "Standard Pressboard" of Part A of Example 1, with the following exceptions. Fibrids were refined and mixed with floc at the paper-making machine. Fifty sheets of wet paper were combined into a wet lap and the entire wet lap was cut into 20-cm (8-in) squares. In pressing the squares of wet lap at 140° C. under a pressure of 35 $kg/cm^2$, the pressure was applied for 30 minutes rather than one hour. The low density pressboard so formed was 2.1 mm (81 mils) thick and had a density of 0.88 $g/cm^3$. Its % $V_v$ was 36%. The low density pressboard was predried at 120° C. in an oven for four hours and then placed between the platens of a flat press preheated to 280° C. as in Part B of Example I. Low pressure was applied briefly at first, with three cycles of release of the pressure to permit escape of the trapped gasses followed by reapplication of the pressure. A pressure of 53 $kg/cm^2$ (5171 kPa; 750 psi) was then applied for a contact time of 1 minute, the hot pressboard finally being cooled under restraint in a separate press. The product, designated as "Sample 4A", was an aramid pressboard 1.75 mm (69 mils) thick and had a density of 1.04 $g/cm^3$. Its % $V_v$ was 25%. $V_{ml}$ was 0.15 cm3/g (rounded from 0.1542) and $V_{mh}$ was 0.17 $cm^3/g$ (rounded from 0.1712), The compression set was 0.20 mm (8.0 mils), the oil absorption was 15.9% by weight of pressboard, and $V_o$ was 0.19 $cm^3/g$. For Sample 4A, $V_a$ was 0.19 $cm^3/g$ and the ratio $V_a/V_{ml}$ was 1.2.

Other 20-cm square sheets of low density pressboard were prepared in the same manner, except that the weight of the solids in the wet paper was approximately 60 g/m$^2$, the wet lap was formed from thirty sheets of wet paper, and in the pressing step the pressure was applied for 45 minutes rather than 30 minutes. The low density pressboard was 2.1 mm (84 mils) thick and had a density of 0.92 g/cm$^3$. Its % $V_v$ was 33%. The low density pressboard was predried and hot pressed in the same manner as Sample 4A, except that the pressure of 53 kg/cm$^2$ was applied for a contact time of 10 minutes. The product, designated as Sample "4B", was an aramid pressboard 1.8 mm (71 mils) thick and had a density of 1.15 g/cm$^3$. Its % $V_v$ was 17%. $V_{ml}$ was 0.05 cm$^3$/g (rounded from 0.0486) and $V_{mh}$ was 0.15 cm$^3$/g (rounded from 0.1452). The compression set was 0.147 mm (5.8 mils), the oil absorption was 9.7% by weight of pressboard, and $V_o$ was 0.11 cm$^3$/g. For Sample 4B, $V_a$ was 0.15 cm$^3$/g and the ratio $V_a/V_{ml}$ was 3.0.

EXAMPLE 5

In a series of experiments, low density pressboards were made which contained varying ratios of MPD-I fibrids and floc. The low density pressboards were made in substantially the same manner as the "Standard Pressboard" of Part A of Example 1 with the following exceptions. Fibrids were refined and then mixed with flock at the paper-making machine in the proportions given below. Wet paper was produced with the weight of the solids being approximately 60 g/m$^2$. Thirty sheets of wet paper were combined into a wet lap which was cut into 20-cm (8-in.) squares and pressed.

In one experiment a mixture of 80% fibrids and 20% floc having a cut length of 0.32 cm (0.125 in) was used. The low density pressboard was prepared under a pressure of 17.6 kg/cm$^2$ (1724 kPa; 250 psi) for 1.5 hr. at a temperature of 140° C. It was approximately 2.1 mm (82 mils) thick and had a density of 0.92 g/cm$^3$. % $V_v$ was 33%.

The low density pressboard was dried at 120° C. for 4 hours and pressed at 280° C. under low pressure at first with brief cycles of release and reapplication of pressure, then for 10 min. at 8.8 kg/cm$^2$ (862 kPa; 125 psi.) The product, designated "Sample 5A", was an aramid pressboard approximately 1.9 mm (73 mils) thick, had a density of 1.04 g/cm$^3$, a compression set of 0.21 mm (8.3 mils), an oil absorption of 13.7% by weight pressboard, and $V_o$ was 0.16 cm$^3$/g. % $V_v$ for sample 5A was calculated as 25%. $V_{ml}$ was 0.10 cm$^3$/g (rounded from 0.0990), $V_{mh}$ was also 0.10 cm$^3$/g (rounded from 0.0996). For sample 5A $V_a$ was 0.16 cm$^3$/g (the largest of the values for $V_{ml}$, $V_o$, and $V_{mh}$) and the ratio $V_a/V_{ml}$ was 1.6.

The procedure for preparing the low density pressboard was repeated, except that a mixture of 40% fibrids and 60% floc was used and that the pressure applied was 35 kg/cm$^2$ (3450 kPa; 500 psi) for a period of 45 minutes at 140° C. The low density pressboard was approximately 2.6 mm (103 mils) thick and had a density of 0.78 g/cm$^3$. % $V_v$ was 43%. The low density pressboard was dried at 120° C. for 4 hours and pressed at 280° C., under low pressure at first with brief cycles of release and reapplication of pressure, then for 10 min. at a pressure of 53 kg/cm$^2$ (5171 kPa), finally being cooled under restraint in a separate press. The product, designated "Sample 5B", was an aramid pressboard approximately 2.0 mm (79 mils) thick, had a density of 1.02 g/cm$^3$, a compression set of 0.15 mm (6.0 mils), an oil absorption of 17.1% by weight of pressboard, and $V_o$ was 0.20 cm$^3$/g. % $V_v$ was 26%. $V_{ml}$ was 0.17 cm$^3$/g (rounded from 0.1683) and $V_{mh}$ was 0.27 cm$^3$/g (rounded from 0.2673). For Sample 5B, $V_a$ was 0.27 cm$^3$/g and the ratio $V_a/V_{ml}$ was 1.6.

The procedure for preparing the low density pressboard was repeated again, except that a mixture of 20% fibrids and 80% floc was used and that the pressure applied was 35 kg/cm$^2$ for a period of 45 minutes at 140° C. The low density pressboard was approximately 3.1 mm (123 mils) thick and had a density of 0.70 g/cm$^3$. % $V_v$ for this low density pressboard was 49%. The low density pressboard was dried as described above and pressed at 280° C., under low pressure at first with brief cycles of release and reapplication of pressure, then for 10 min. at 79 kg/cm$^2$ (7763 kPa; 1125 psi). The product, designated "Sample 5C", was an aramid pressboard approximately 2.1 mm (84 mils) thick, had a density of 1.03 g/cm$^3$, a compression set of 0.35 mm (13.6 mils), an oil absorption of 12.1% by weight of pressboard, and $V_o$ was 0.14 cm$^3$/g. % $V_v$ was 25%. $V_{ml}$ was 0.16 cm$^3$/g (rounded from 0.1565) and $V_{mh}$ was 0.23 cm$^3$/g (rounded from 0.2342). For Sample 5C, $V_a$ was 0.23 cm$^3$/g and the ratio $V_a/V_{ml}$ was 1.5.

The procedure for preparing the low density pressboard was repeated once more, except that a mixture of 95% fibrids and 5% floc was used and that the pressure applied was 17.6 kg/cm$^2$ for a period of 1.5 hr at 140° C. The low density pressboard was approximately 1.9 mm (75 mils) thick and had a density of 0.90 g/cm$^3$. % $V_v$ was 35%. The low density pressboard was dried as described above and pressed at 280° C., under low pressure at first with brief cycles of release and reapplication of pressure, then for 10 min at 8.8 kg/cm$^2$. The product, designated "Sample 5D", was an aramid pressboard approximately 1.7 mm (68 mils) thick, had a density of 1.06 g/cm$^3$, a compression set of 0.34 mm (13.4 mils), an oil absorption of 11.7% by weight of pressboard, and $V_o$ was 0.14 cm$^3$/g. % $V_v$ was 23%. $V_{ml}$ was 0.05 cm$^3$/g (rounded from 0.0459) and $V_{mh}$ was 0.08 cm$^3$/g (rounded from 0.0805). For Sample 5D, $V_a$ was 0.14 cm$^3$/g and the ratio $V_a/V_{ml}$ was 3.0.

EXAMPLE 6

In a series of experiments, low density pressboards based partly on high-temperature resistant flocs other than MPD-I flocs were made. The low density pressboards were made in substantially the same manner as the "Standard Pressboard" of Part A of non-MPD-I floc was blended with MPD-I floc having a cut length of 0.32 cm (0.125 in.) and the blend of flocs was mixed at the paper machine with refined fibrids in the proportions given below. Wet paper was produced with the weight of the solids being approximately 60 g/m$^2$. Thirty sheets of wet paper were combined into a wet lap which was cut into 20-cm (8-in.) squares and pressed under the conditions given in Ex. 1, Part A.

In one experiment, a mixture of 60% MPD-I fibrids, 20% MPD-I floc, and 20% commercially available poly(p-phenylene terephthalamide) (PPD-T) floc having a linear density of 1.67 decitex (1.5 denier) and a cut length of 0.32 cm (0.125 in.) was used to prepare an low density pressboard having a thickness of 2.9 mm (113 mils), a density of 0.83 cm$^3$/g, and a % $V_v$ of 41%. The low density pressboard was dried at 120° C. for 4 hours and pressed at 280° C., under low pressure at first with brief cycles of release and reapplication of pressure, then at 53 kg/cm$^2$ (5171 kPa; 750 psi) for 10 min., the hot pressboard finally being cooled under restraint in a separate press. The product, designated as "Sample 6A" was a pressboard 2.2 mm (86 mils) thick having a density of 1.10 g/cm$^3$, a % $V_v$ of 22%, a compression set of 0.27 mm (10.8 mils), an oil absorption of 10.8% by weight of pressboard, and a $V_o$ of 0.13 cm$^3$/g. $V_{ml}$ was 0.08 cm$^3$/g (rounded from 0.0787) and $V_{mh}$ was 0.12 cm$^3$/g (rounded from 0.1151). $V_a$ for Sample 6A was 0.13 cm$^3$/g and the ratio $V_a/V_{ml}$ was 1.6.

In another experiment, a mixture of 60% MPD-I fibrids, 35% MPD-I floc, and 5% E-glass fiber floc having a density of 2.4 g/cm$^3$ a linear density of 3.3 decitex (3 denier), and a cut length of 0.64 cm (0.25 in) was used to prepare an low density pressboard having a thickness of 2.2 mm (88 mils), a density of 0.91 cm$^3$/g, and a % $V_v$ of 36%. The low density pressboard was dried and pressed by the same procedure described above for making Sample 6A. The product, designated as "Sample 6B", was an aramid/glass fiber pressboard 1.8 mm. (71 mils) thick having a density of 1.15 g/cm$^3$, a % $V_v$ of 20%, a compression set of 0.18 mm (7 mils), an oil absorption of 8.6% by weight of pressboard and a $V_o$ of 0.10 cm$^3$/g. $V_{ml}$ was 0.06 cm$^3$/g (rounded from 0.0576) and $V_{mh}$ was 0.14 cm$^3$/g (rounded from 0.1424). $V_a$ for Sample 6B was 0.14 cm$^3$/g and the ratio $V_a/V_{ml}$ was 2.5.

CONTROL SAMPLES OUTSIDE THE INVENTION (1) The procedure of Example 1, Part B, was repeated, except that the pressure was increased to 53 kg/cm$^2$ (5171 kPa; 750 psi), the press again being maintained at a temperature of 280° C. This product, designated as "Control 1" had an oil absorption of only 2.03%. It was about 2.2 mm (87 mils) thick (thickness range 2.14–2.31 mm) and had a density of 1.21 g/cm$^3$, a % $V_v$ of 12%, and a compression set of 0.30 mm (12 mils). $V_o$ was 0.023 cm$^3$/g, $V_{ml}$ was 0.04 cm$^3$/g (rounded from 0.0433), and $V_{mh}$ was 0.09 cm$^3$/g (rounded from 0.0889). For Control 1, $V_a$ was 0.04 cm$^3$/g and the ratio $V_a/V_{ml}$ was 2.05.

(2) The procedure for preparing "Standard Pressboard" as described in Example 1, Part A, was repeated, except that the plants of the press were heated to 200° C. and, after loading the press at contact pressure, the pressure was raised to and maintained at 60 kg/cm$^2$ (5880 kPa; 850 psi) for one hour while the platens of the press were maintained at 200° C. The product, designated as "Control 2", had a high value of compression set of 1.0 mm (40 mils). It had a density of 1.07 g/cm$^3$, a %$V_v$ of 22%, and an oil absorption of 9.59%. $V_o$ was 0.11 cm$^3$/g, $V_{ml}$ was 0.17 cm$^3$/g (rounded from 0.1733 cm$^3$/g), and $V_{mh}$ was also 0.17 cm$^3$/g (rounded from 0.1723). For Control 2, $V_a$ was 0.17 cm$^3$/g and the ratio $V_a/V_{ml}$ was 1.0.

(3A) Filaments of MPD-I were prepared substantially as described by Gross in U.S. Pat. No. 3,756,908, Column 6, lines 11–23. The resulting high modulus filaments were then cut to a floc having a length of about 0.64 cm (0.25 in) and then slurried in water to a concentration of about 0.3%.

Fibrids of MPD-I were prepared substantially as described in column 5, lines 34–57 of the same patent. The refined fibrids were then diluted further in water to a concentration of about 0.5%, and passed to a mixing "T" along with the above mentioned slurry of high modulus floc, at a ratio of fibrid to floc of about 1.55 to 1.0 (60% fibrids and 40% floc). The mixture was directed to the headbox of a Fourdrinier paper-making machine and then to a forming wire for production of a wet sheet. The wet sheet was then removed from the wire and passed through steam heated dryer caps to reduce the moisture content of the sheet to about 5% or less. The paper was then wound on a roll for further processing.

The paper was removed from its roll, cut into 20-cm (8-in) squares, and then platen pressed to produce samples of 2-ply paper substantially as described in column 7, lines 6–11, of the same patent. The samples of 2-ply paper were pressed at 70.3 kg/cm$^2$ (689.5 kPa; 1000 psi) and 280° C. for one minute. The resulting paper, designated as "Control 3A" had a thickness of about 0.25 mm (10 mils), a density of about 0.87 g/cm$^3$, and a % $V_v$ of 37% by volume of the paper. $V_{ml}$ was 0.28 cm$^3$/g (rounded from 0.2842) and $V_{mh}$ was 0.18 cm$^3$/g (rounded from 0.1818). The compression set was 1.0 mm (40 mils), the oil absorption was 35.3% by weight of paper, and $V_o$ was 0.41 cm$^3$/g. For Control 3A, $V_a$ was 0.41 cm$^3$/g and the ratio $V_a/V_{ml}$ was 1.5.

(3B) Filaments of MPD-I were prepared substantially as described by Gross in U.S. Pat. No. 3,756,908, column 5, lines 68–75, and column 6, lines 1–7, resulting in low modulus filaments which were then cut to a floc having a length of about 0.64 cm (0.25 in) and slurried in water to a concentration of 0.2%.

Fibrids of MPD-I were prepared as described above for Control 3A and papers were prepared by combining the fibrid and the low modulus floc at a ratio of fibrid to floc of 1.5 to 1.0 (60% fibrid and 40% floc) in a wet 20-cm (8-in) square handsheet mold (e.g., of the type made by Noble and Wood). Papers made in this way are considered to be essentially the same as papers made on a Fourdrinier paper machine. The wet sheets were removed from the 100 mesh screen of the handsheet mold and dried on hot sheet dryers to reduce the moisture content to about 5% or less. The sheets were then platen pressed to produce samples of 2-ply paper. They were pressed at 70.3 kg/cm$^2$ (689.5 kPa; 1000 psi) and 260° C. for one minute.

The resulting paper, designated as "Control 3B" had a thickness of about 0.29 mm (11 mils), a density of about 0.77 g/cm$^3$, and a % $V_v$ of 44% by volume of the paper. $V_{ml}$ was 0.58 cm$^3$/g (rounded from 0.5787) and $V_{mh}$ was 0.38 cm$^3$/g (rounded from 0.3793). The compression set was 1.4 mm (54 mils), the oil absorption was 49.9% by weight of the paper, and $V_o$ was 0.58 cm$^3$/g. For Control 3B, $V_a$ was 0.58 cm$^3$/g and the ratio $V_a/V_{ml}$ was 1.0.

(4) The procedure of Example 5 for preparing Sample 5D was repeated, using a mixture of 95% fibrids and 5% floc, except that the low density pressboard was prepared by applying a pressure of 35 kg/cm$^2$ (3450 kPa; 500 psi) for a period of 45 minutes at 140° C. The low density pressboard was approximately 1.7 mm (68 mils) thick and had a density of 1.00 g/cm$^3$. % $V_v$ was 28%. The low density pressboard was dried at 120° C. for 4 hrs and pressed at 280° C., under low pressure at first with brief cycles of release and reapplication of pressure, then for 5 min at 8.8 kg/cm$^2$. The product, designated "Control 4", was an aramid pressboard approximately 1.6 mm (62 mils) thick, had a density of 1.12 g/cm$^3$, a compression set of 0.14 mm (5.5 mils), an oil absorption of 1.4% by weight of pressboard, and $V_o$ was 0.02 cm$^3$/g. % $V_v$ was 19%. $V_{ml}$ was 0.01 cm$^3$/g (rounded from 0.0141) and $V_{mh}$ was 0.02 cm$^3$/g (rounded from 0.0173). For "Control 4", Va was 0.02 $cm^3/g$ and the ratio $V_a/V_{ml}$ was 1.2.

The properties and void parameters for all of the pressboard samples prepared as described in the examples, together with the control samples, are listed in the Table. The "Standard Pressboard" (abbreviated Std. Pressboard) sample of Part A of Example 1, is also listed. In the Table, the samples are listed in descending order according to their calculated void volume, % $V_v$.

TABLE

PRESSBOARD PROPERTIES AND VOID PARAMETERS

| Sample Identification | % $V_v$ | Density, $g/cm^3$ | Oil Abs., wt. % | Comp. Set, mm | $V_{ml}$, $cm^3/g$ | $V_{mh}$, $cm^3/g$ | $V_o$, $cm^3/g$ | $V_a$, $cm^3/g$ | Ratio** $\frac{V_a}{V_{ml}}$ |
|---|---|---|---|---|---|---|---|---|---|
| Control 3B | 44 | .77 | 49.9 | 1.4 | .58 | .38 | .58 | .58 | 1.0 |
| Std. Pressboard | 41 | .82 | 32.5 | 2.1 | .38 | .42 | .38 | .42 | 1.1 |
| Control 3A | 37 | .87 | 35.3 | 1.0 | .28 | .18 | .41 | .41 | 1.5 |
| *Sample 5B | 26 | 1.02 | 17.1 | 0.15 | .17 | .27 | .20 | .27 | 1.6 |
| *Sample 5C | 25 | 1.03 | 12.1 | 0.35 | .16 | .23 | .14 | .23 | 1.5 |
| *Sample 4A | 25 | 1.04 | 15.9 | 0.20 | .15 | .17 | .19 | .19 | 1.2 |
| *Sample 5A | 25 | 1.04 | 13.7 | 0.21 | .10 | .10 | .16 | .16 | 1.6 |
| *Sample 5D | 23 | 1.06 | 11.7 | 0.34 | .05 | .08 | .14 | .14 | 3.0 |
| *Sample 1B | 22 | 1.08 | 12.2 | 0.36 | .16 | .17 | .14 | .17 | 1.1 |
| *Sample 6A | 22 | 1.10 | 10.8 | 0.27 | .08 | .12 | .13 | .13 | 1.6 |
| Control 2 | 22 | 1.07 | 9.6 | 1.0 | .17 | .17 | .11 | .17 | 1.0 |
| *Sample 1A | 20 | 1.11 | 12.7 | 0.30 | .15 | .17 | .15 | .17 | 1.1 |
| *Sample 6B | 20 | 1.15 | 8.6 | 0.18 | .06 | .14 | .10 | .14 | 2.5 |
| Control 4 | 19 | 1.12 | 1.4 | 0.14 | .01 | .02 | .02 | .02 | 1.2 |
| *Sample 2 | 19 | 1.12 | 9.3 | 0.13 | .09 | .17 | .11 | .17 | 1.8 |
| *Sample 3 | 18 | 1.13 | 9.3 | 0.13 | .06 | .14 | .11 | .14 | 2.5 |
| *Sample 4B | 17 | 1.15 | 9.7 | 0.15 | .05 | .15 | .11 | .15 | 3.0 |
| Control 1 | 12 | 1.21 | 2.0 | 0.30 | .04 | .09 | .02 | .09 | 2.1 |

*Samples illustrative of the scope of the invention

**Ratio calculated before rounding $V_a$ and $V_{ml}$ to two decimal places

What is claimed is:

1. High density pressboard comprised of 20–95% by weight aromatic polyamide fibrids and 80–5% by weight high temperature resistant floc, said pressboard having a calculated void volume of 13 to 28% by volume of the pressboard, a thickness of 0.5 to 50 mm, a mercury intrusion volume at low surface/volume, $V_{ml}$, of less than 0.20 $cm^3/g$; a mercury intrusion volume at high surface/volume, $V_{mh}$, of 0.08 to 0.28 $cm^3/g$, an oil absorption by volume in $cm^3/g$, $V_o$, of 0.09 to 0.28 and by weight of 8–24 wt.%; and a total available absorption volume in $cm^3/g$, $V_a$, equal to the largest of the values for $V_{ml}$, $V_{mh}$, and $V_o$; the ratio of $V_a$ to $V_{ml}$ being at least 1.1; said pressboard having a compression set of greater than 0.12 mm but less than 0.35 mm.

2. Pressboard of claim 1 wherein the high temperature resistant floc is an aromatic polyamide floc and the pressboard has a density of 1.0 to 1.20 $g/cm^3$.

3. Pressboard of claim 2 wherein at least a portion of the floc consists of poly(p-phenylene terephthalamide).

4. Pressboard of claim 1 wherein at least a portion of the floc is glass fiber floc.

5. Pressboard of claim 2 wherein the aromatic polyamide fibrids and floc consist essentially of poly(m-phenylene isophthalamide).

6. Pressboard of claim 5 wherein the pressboard is comprised of 50–70% by weight fibrids and 50–30% by weight floc.

7. Pressboard of claim 6 wherein the density is 1.02 to 1.17 $g/cm^3$.

8. Pressboard of claim 7 wherein the density is 1.10 to 1.15 $g/cm^3$.

9. Pressboard of claim 6 wherein the compression set is greater than 0.20 mm but less than 0.30 mm.

10. Process for preparing the high density pressboard of any one of claims 1–9 whereby an aqueous slurry having 0.1 to 2% by weight total solids comprised of 20–95% by weight fibrids of an aromatic polyamide and 80–5% by weight of high temperature resistant floc having a length of 2 to 12 mm, said aromatic polyamide fibrids and said high temperature resistant floc having a melting point higher than 320° C., the slurry is formed into a waterleaf having a water content of 50–95% by weight of the waterleaf; the waterleaf is combined into multiple layers to form a wet lap; the wet lap is pressed at 100° to 200° C. under a pressure of 10 to 60 $kg/cm^2$ to form a low density pressboard having a calculated void volume of 30 to 60% by volume of the pressboard, the low density pressboard is dried, ultimately at 270° to 320° C. until substantially no further moisture is evolved and then pressed at 8 to 350 $kg/cm^2$ at 270° to 320° C.

11. The process of claim 10 wherein the high temperature resistant floc is comprised of an aromatic polyamide.

12. The process of claim 11 wherein the pressboard is comprised of 50–70% by weight of poly(m-phenylene isophthalamide) fibrids and 30–50% by weight of poly(m-phenylene isophthalamide) floc.

13. Process of claim 12 wherein the low density pressboard is dried, ultimately at 275°–300° C., and pressed at 275°–285° C. and 15 to 70 $kg/cm^2$.

14. The process of claim 13 wherein the final pressboard is cooled under restraint.

* * * * *